US006192784B1

(12) United States Patent
Kato et al.

(10) Patent No.: US 6,192,784 B1
(45) Date of Patent: Feb. 27, 2001

(54) SWASH PLATE COMPRESSOR

(75) Inventors: Takayuki Kato; Norikazu Deto; Hayato Ikeda; Noriyuki Shintoku; Seiji Katayama; Shinya Kawakami; Hiroshi Kanayama; Chiaki Gouhara, all of Aichi-ken (JP)

(73) Assignees: Kabushiki Kaisha Toyoda Jidoshokki Seisakusho, Kariya; Taiho Kogyo Co., Ltd., Toyota, both of (JP)

( * ) Notice: Subject to any disclaimer, the term of this patent is extended or adjusted under 35 U.S.C. 154(b) by 0 days.

(21) Appl. No.: 09/171,310

(22) PCT Filed: Feb. 13, 1998

(86) PCT No.: PCT/JP98/00603

§ 371 Date: May 21, 1999

§ 102(e) Date: May 21, 1999

(87) PCT Pub. No.: WO98/36173

PCT Pub. Date: Aug. 20, 1998

(30) Foreign Application Priority Data

Feb. 14, 1997 (JP) ..... 9-030318

(51) Int. Cl.[7] ..... F01B 3/00; F01B 31/10
(52) U.S. Cl. ..... 92/71; 92/155
(58) Field of Search ..... 92/12.2, 71, 155

(56) References Cited

U.S. PATENT DOCUMENTS 4,568,252 2/1986 Hattori et al. ..... 92/71
5,056,417 10/1991 Kato et al. ..... 92/71
5,875,702 3/1999 Kawagoe et al. ..... 92/71

FOREIGN PATENT DOCUMENTS 57-146070 9/1982 (JP) .
8-199327 * 8/1996 (JP) .
96/36745 11/1996 (WO) .

OTHER PUBLICATIONS

"Surface roughness– Definitions and designation" in Japanese Industrial Standard, JIS B 0601–1994.*
Broadston, J.A. "Surface Texture Designation, Production, and Control" in Marks' Standard Handbook For Mechanical Engineers (New York, McGraw–Hill, Inc, 1987) pp. 13–75 –13–81, TJ 151.m37 1987 c4.

* cited by examiner

*Primary Examiner*—F. Daniel Lopez
(74) *Attorney, Agent, or Firm*—Morgan & Finnegan, L.L.P.

(57) ABSTRACT

The invention is related to a swash plate compressor in which the wear resistance and the lubricating ability of the surfaces of the swash plate which are in contact with the shoes can be enhanced and maintained for a long period of time. In the swash plate compressor, a soft surface coating 21 is formed on sliding surfaces of any of a swash plate or shoes and the coarseness at ten point mean roughness of the surface of the substrate is made to be 8 μmRz or less, and preferably 5 μmRz or less, and more preferably 3 μmRz or less. Even if the soft surface coating 21 is partially worn or exfoliated by a sliding load, since the temperature of the soft surface coating 21 is increased by frictional heat and the soft surface coating 21 is fluidized, the worn or exfoliated portions are repaired. The soft surface coating 21 is preferably composed of a coating layer containing molybdenum disulfide.

11 Claims, 3 Drawing Sheets

SWASH PLATE COMPRESSOR

FIELD OF THE INVENTION

The present invention relates to a swash plate compressor, and more specifically, to a soft surface coating substrate treatment applied to sliding surfaces between a swash plate and shoes.

BACKGROUND OF THE INVENTION

Conventionally, swash plate compressors are used in automotive air conditioners and the like as a device for compressing a refrigerant gas. The swash plate compressor is composed of a cylinder block having a plurality of cylinder bores disposed in a direction parallel to an axial center, a swash plate held on a drive shaft in the cylinder block so as to rotate integrally with the drive shaft, pistons sidably inserted in the cylinder bores, and shoes for reciprocatively moving the pistons by the rotation of the swash plate.

Generally, a large load and a large slipping speed act on the sliding surfaces of the swash plate and the shoes of the swash plate compressor. In particular, the effect of the load is large when aluminum or an aluminum alloy is used as the base metal of the swash plate to reduce the weight thereof. Accordingly, consideration must be given to the lubricating ability under severe sliding conditions such as when there is no lubrication at start up or when there is a high sliding load.

A soft surface coating having a low frictional resistance which is applied to one of the opposed surfaces of the swash plate and the shoes to reduce the frictional resistance of the sliding surfaces between the swash plate and the shoes is disclosed in, for example, Japanese Patent Application Laid-open No. 2-130272 and Japanese Patent Application Laid-open No. 60-22080. That is, a soft surface coating composed of only tin or tin and a metal selected from copper, nickel, zinc, lead, indium, etc. is proposed in the former publication, and a coating containing a solid lubricant such as molybdenum disulfide, tungsten disulfide, graphite, boron nitride, lead oxide, fluoro-resin, etc. is proposed in the latter publication When a surface coating is applied, a common practice in the conventional way of thinking is to coarsen the surface of the base or substrate for the surface coating by shot blasting or the like. Specifically, a average coarseness of the substrate is made to be about 10 $\mu$mRz at ten point mean roughness to increase the adhesive properties of the surface coating with the substrate so that the surface coating does not exfoliate easily.

Note that when the surface coating is directly formed on the surface of the base metal of the swash plate or the shoes, the surface of the base metal serves as the substrate referred to here. However, when a coating having a high wear resistance is applied to the surface of the base metal, as a countermeasure to the surface coating being worn, and then the soft surface coating is applied thereon, the surface of the high wear resistance coating serves as the substrate. When the base metal is composed of, for example, aluminum, it is known to apply an aluminum anode coating to the surface of the base metal as the high wear resistance coating.

However, the conventional arrangement as described above has a problem in that although excellent lubricating properties can be achieved when the soft surface coating is not worn, the life of the soft surface coating cannot be prolonged because it has low resistance to wear. Further, although a soft surface coating such as one containing molybdenum disulfide and the like is characterized in that it fluidizes as its temperature increases, it has not yet been conceived of to make use of this feature because the surface of the substrate of the soft surface coating is coarsened to increase mechanical adhesive properties between the soft surface coating and the substrate.

Accordingly an object of the present invention made in view of the problems of the prior art is to enhance the lubricating ability and wear resistance of the sliding surfaces of a swash plate and shoes and maintain them for a long period of time.

SUMMARY OF THE INVENTION

To achieve the above object, in the invention, a swash plate compressor includes a cylinder block having a plurality of cylinder bores, a drive shaft rotatably supported in the cylinder block, a swash plate rotating with the drive shaft, pistons sidably disposed in the cylinder bores, and shoes sidably interposed between the pistons and the swash plate to reciprocatively move the pistons by the rotation of the swash plate, in which a soft surface coating is formed on the sliding surfaces of any one of the swash plate and the shoes which come into contact with each other, wherein the coarseness of the surface of the substrate for the soft surface coating is made to be a coarseness of 8 $\mu$mRz or less at ten points.

In this case, the soft surface coating is one having a high lubricating ability and when the surface coating is partially worn or exfoliated by the sliding contact of the swash plate with the shoes during operation of the compressor, the surface coating at the periphery of the portions that are worn or exfoliated are softened and fluidized by the temperature increase due to sliding friction.

Since the above arrangement permits the soft surface coating having a high lubricating ability to be formed on the sliding surfaces of the swash plate which comes into contact with the shoes, the lubricating ability is improved.

Note here that the soft surface coating has a drawback in that it has low wear resistance.

However, observed at particular points, a load acting on the swash plate through the shoes is large when the pistons are at their top dead centers and small when they are at their bottom dead centers. Thus, when the pistons are at their top dead centers a large sliding contact force acts on the swash plate through the shoes and the portions where the sliding contact force acts are worn or exfoliated when the compressor is used for a long period of time. When the soft surface coating is partially worn or exfoliated as described above, the soft surface coating at the peripheries of the worn or exfoliated portions are softened and fluidized by the temperature increase due to frictional heat. On the other hand, the mechanical adhesive properties between the soft surface coating and the substrate thereof are weakened when the coarseness of the surface of the substrate is processed to an average coarseness of 8 $\mu$mRz or less at ten point mean roughness. As a result, when the sliding load is intermittently reduced, the softened soft surface coating material at the peripheries of the worn or exfoliated portions flows to the portions where the soft surface coating is worn or exfoliated and the soft surface coating is thereby repaired.

Although the sliding load acting on the sliding surface of the swash plate and the shoes periodically increases and decreases as described above, the soft surface coating is always repaired when the load decreases. Accordingly, high wear resistance and high lubricating ability can be maintained for a long period of time.

In the invention, it is preferable that the coarseness be 5 μmRz or less at ten point mean roughness , and it is more preferable that it is 3 μmRz or less at ten point mean roughness.

With this arrangement, since the mechanical adhesive properties between the soft surface coating and the substrate are further weakened, the fluidity of the soft surface coating is further increased and the portions where the soft surface coating are worn or exfoliated are more promptly repaired, and the high wear resistance and high lubricating ability can thereby be maintained for a longer period of time.

In the invention, the soft surface coating is, for example, a coating layer containing molybdenum disulfide.

With this arrangement, the fluidity of the soft surface coating is further increased, and the high wear resistance and high lubricating ability are further exhibited and maintained.

In the invention, a plating layer mainly composed of soft metal, more specifically, tin, is formed on the sliding surfaces of any one of the swash plate and the shoes, and a coating layer containing molybdenum disulfide is formed on the plating layer as the soft surface coating.

In this case, a plating layer mainly composed of tin includes not only one composed of only tin, but also one in which the weight of the tin is greatest among the alloy components.

With this arrangement, since the plating layer mainly composed of tin has better adhesive properties with the base metal than the coating layer containing molybdenum disulfide and has excellent wear resistance, even when the swash plate is subjected to a large sliding load from the pistons when they are moving near their top dead centers and thereby wear or exfoliate the coating layer containing molybdenum disulfide, the plating layer is maintained as the substrate of the coating layer. Further, the coating layer as the soft surface coating has good compatibility with the plating layer as the substrate.

Accordingly, the dual surface coatings are formed on the base metal. Further, the fluidity of the soft surface coating is increased compared to when the coating layer containing molybdenum disulfide is directly formed on the surface of the base metal of the swash plate. As a result, the wear resistance and lubricating ability can be further enhanced and maintained for a longer period of time.

In the invention, the swash plate is composed of aluminum or an aluminum alloy and the soft surface coating is formed on the sliding surfaces of the swash plate which come into contact with the shoes to include at least the portions thereof subjected to a sliding load from the shoes when the pistons are moving near their top dead centers.

With the above arrangement, the weight of the compressor is reduced without shortening its life because the high wear resistance and high lubricating ability can be maintained for a long period of time, even if a soft aluminum material is used for the swash plate.

BEST MODE FOR CARRYING OUT THE INVENTION

A first embodiment of a swash plate type compressor having double-headed pistons of the present invention will be described in detail with reference to FIG. 1 to FIG. 4.

Figure 1:
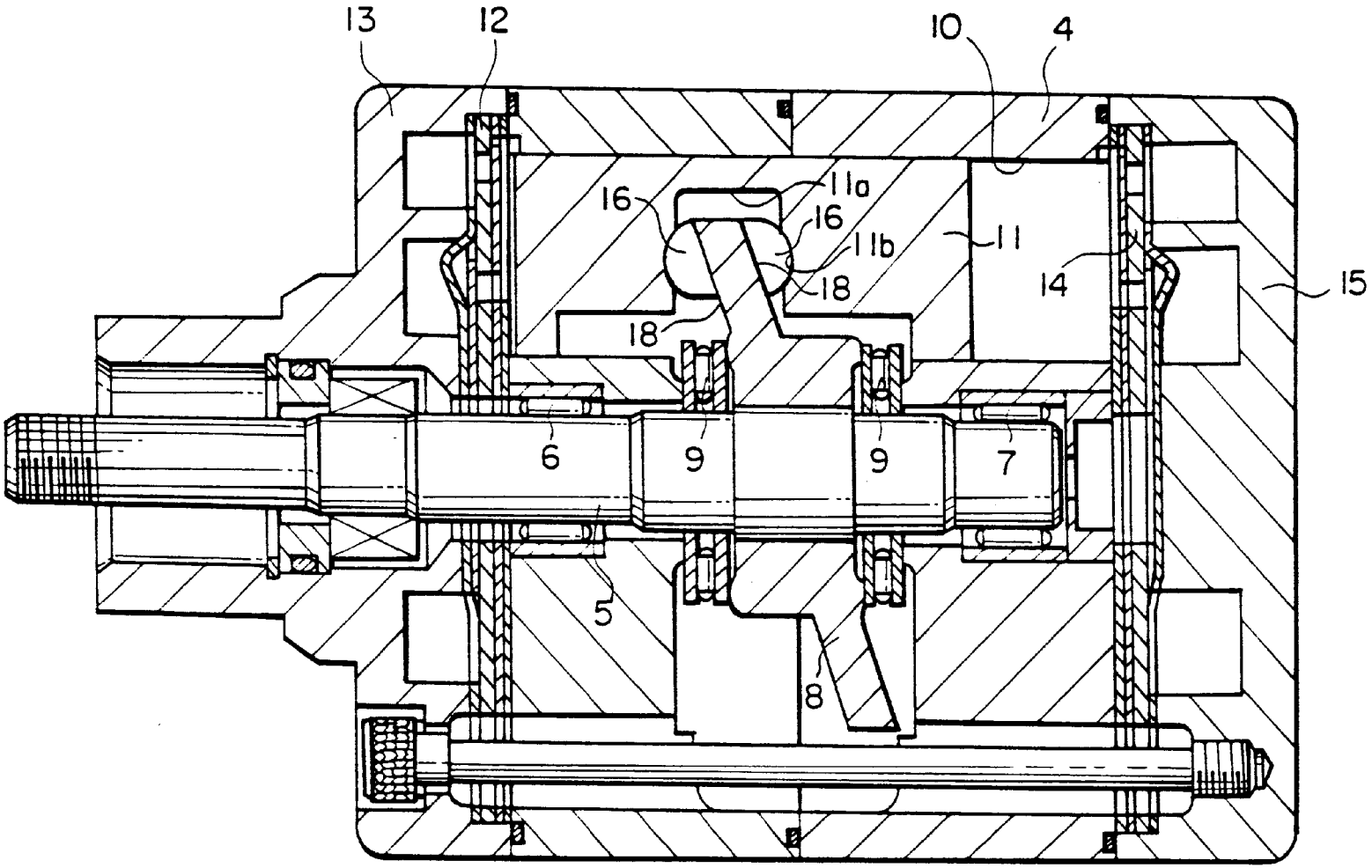
FIG. 1 is a sectional view showing the overall arrangement of a swash plate type compressor having double-headed pistons according to first and second embodiments.

FIG. 1 is a sectional view of the entire swash plate compressor of the first embodiment, in which numeral 4 denotes an approximately cylindrical cylinder block, and 5 denotes a drive shaft rotatably journaled in the cylinder block 4 through bearings 6, 7. A swash plate 8 is secured to the drive shaft 5 with thrust bearings 9 disposed at both forward and rearward sides thereof.

Five cylinder bores 10, which are parallel with an axial center, are formed in the cylinder block 4 on a circumference having a predetermined radius from the axial center at equal intervals, ordinarily 72 degrees. Double-headed pistons 11 are disposed in the respective cylinder bores 10 so as to be sidably engaged therewith. The left end opening of the cylinder block 4 is closed by a valve plate 12 and a front housing 13 and the right end opening thereof is closed by a valve plate 14 and a rear housing 15.

A recessed portion 11*a* is formed in the central portion of each piston 11 so as to accommodate the outer peripheral portion of the swash plate 8 and spherical recessed portions 11*b* are formed in opposed surfaces of the recessed portion 11*a* in the axial direction. Approximately semi-spherical shoes 16 come into sliding contact with the right and left outer peripheral portions of the swash plate 8 so that the rotation of the swash plate 8 is transmitted to the pistons 11 as a reciprocating motion. The above arrangement is fundamentally the same as the structure of conventional ordinary swash plate type compressors having double-headed pistons.

In the first embodiment, the shoes 16 employ a ferrous metal such as stainless steel or the like as a base metal. However, even though the swash plate 8 may employ a ferrous metal as a base metal, aluminum or an aluminum alloy may be used as a base metal for weight reduction. Although, for example, Al-high-Si alloy, Al-Si-Mo alloy, Al-Si-Cu-Mg alloy or aluminum alloy that do not contain Si may be used as the aluminum alloy, it is preferable to use an alusil alloy containing proeutectic silicon. Alusil alloys have a high silicon content of about 13–30 wt %, which is higher than that of an eutectic composition, and include proeutectic silicon in matrixes.

Figure 2:
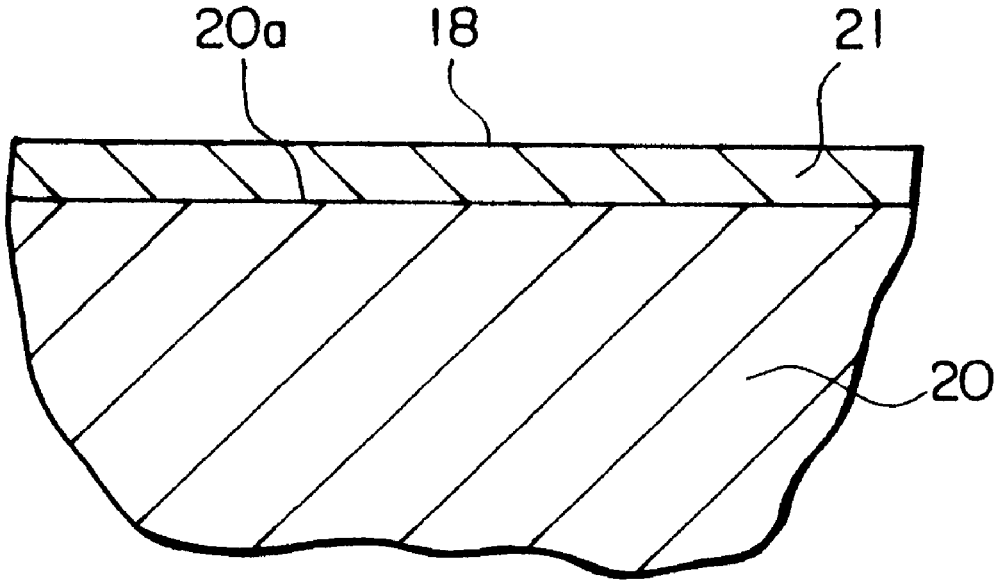
FIG. 2 is a sectional view of the sliding surface portion of a swash plate main body according to the first embodiment.

In the first embodiment, with regards to the swash plate 8 and the shoes 16, which are in sliding contact with each other, the entire sliding surface of the swash plate 8 is arranged as described below. That is, as shown in FIG. 2, which is a sectional view of the main portion of a swash plate main body 20, a soft surface coating 21 is formed on the base metal surface 20*a* of the swash plate main body 20 whose base metal is composed of an alusil alloy containing 17 wt % of silicon.

Although it is thought that the soft surface coating 21 should be composed of tin only or tin along with a metal selected from copper, nickel, zinc, lead, indium, etc., it is preferable that the soft surface coating 21 should be composed of a coating containing a solid lubrication material such as molybdenum disulfide, tungsten disulfide, graphite, boron nitride, lead oxide, fluororesin, etc., and it is most preferable that it should be composed of a coating layer containing molybdenum disulfide from the stand point of fluidity of the soft surface coating.

The base metal surface 20*a* of the swash plate main body 20 which constitutes the substrate for the soft surface coating 21 is finished to a average coarseness of about 8 μmRz or less or less, preferably 5 μmRz or less or less, and more preferably 3 μmRz or less at ten point mean roughness by a process to make the surfaces coarse, for example, grinding, cutting, shot blasting etc. so that the soft surface coating 21, such as the alloy coating layer or the like containing molybdenum disulfide, displays more fluidity.

Further, the coating layer containing molybdenum disulfide may be formed by coating such as by spraying, transfer. Here, if the coating is formed by spraying, the coarseness of its surface and its thickness can be kept constant. However, if the coating layer is formed by transfer, its surface will be slightly coarsened. For this reason, the coating layer formed by transfer may be polished to reduce its surface coarseness, and its thickness may thereby be controlled to be kept constant.

Although mentioned above in detail, from the stand point of stressing the importance of the fluidity of the soft surface coating 21, the most suitable arrangement is such that the coarseness of the base metal surface 20*a* of the swash plate main body 20 be made to 3 μmRz or less at ten point mean roughness and the coating layer containing molybdenum disulfide be formed on the base metal surface 20*a* as the soft surface coating 21. Besides molybdenum disulfide, the coating layer may contain polyamide-imide resin, etc. as a binder, and also contain graphite, etc., as a solid lubricant.

When one of the heads of the double-headed pistons 11 is at its top dead center, a maximum sliding load acts on the portions of the sliding surface 18 of the swash plate 8 that come into sliding contact with the shoe 16 on the top dead center side, whereas when one of the heads of the double-headed pistons 11 is at its bottom dead center, a minimum sliding load acts on the portions of the sliding surface 18 that come into sliding contact with the shoes 16 on the bottom dead center side. Note, in FIG. 1, the sliding surface portions of the swash plate 8 which are in sliding contact with the shoes 16 when the pistons 11 are at their top dead centers are the upper portion of the front side (the left side in FIG. 1) surface portion of the swash plate 8 and the lower portion of the rear side (the right side in FIG. 1) surface portion thereof in FIG. 1.

Further, in observing certain portions of the sliding surfaces 18 of the swash plate 8, the shoes 16 are formed in approximately semi-spherical shapes and since five sets of them in total are disposed at intervals on a predetermined circumference about the axial center of the drive shaft 5 (in the first embodiment, they are disposed at equal intervals of 72 degrees), certain portions are not always in contact with the shoes 16, but are intermittently in contact therewith at a given period in time, and further, although this is a matter of course, when those portions are not in contact with the shoes 16, no sliding load acts on them.

Therefore, the coating layer containing molybdenum disulfide as the soft surface coating 21 is worn or exfoliated due to the deterioration of the wear resistance of the coating layer when one of the heads of the pistons 11 is moving near its top dead center when the swash plate compressor having double-headed pistons is used for a long time. Accordingly, there is a possibility that the base metal surface 20*a* of the swash plate main body 20 will be become exposed.

When this occurs, the coating layer containing molybdenum disulfide as the soft surface coating 21 is softened by a temperature increase caused by frictional heat between the swash plate main body 20 and the shoes 16 and is softened at the periphery of the portion where the base metal surface 20*a* of the swash plate main body 20 is exposed. Further, since the coarseness of the base metal surface 20*a* of the swash plate main body 20 is finished to a fine value of 8 μmRz or less at ten point mean roughness as described above, the mechanical adhesive properties of the soft surface coating 21 with the base metal surface 20*a* of the swash plate main body 20 are weak and a state of high fluidity is achieved.

Therefore, when the soft surface coating is worn away at the sliding contact portion of the swash plate 8, which is in sliding contact with the shoe 16 at the top dead center side when one of the heads of pistons 11 is at an top dead center, the softened soft surface coating material, that is, molybdenum disulfide flows from the periphery of the worn portion into the worn portion when that portion is not in contact with the shoes 16*a,* and the soft surface coating 21 containing the molybdenum disulfide is restored and formed again on the exposed base metal surface 20*a* of the swash plate main body 20.

In the conventional method of forming the soft surface coating, the sliding surface of the swash plate main body to which the soft surface coating is applied is coarsely finished by shot blasting or the like to enhance the mechanical adhesive properties between the soft surface coating and the base metal surface of the swash plate main body, and the coarseness thereof is made to about 10 μmRz at ten point mean roughness. Further, since importance is attached to the adhesive properties between the soft surface coating material and the base metal surface of the swash plate main body as the substrate thereof, a material which has strong adhesive properties such as tin and a metal selected from copper, nickel, zinc, lead, indium, etc., in a specific ratio is particularly preferred.

As a result, since the adhesive properties between the soft surface coating and the base metal surface of the swash plate main body are strong with the conventional method, even if the soft surface coating is partially worn or exfoliated by the sliding friction between the swash plate main body and the shoes as described above and the fluidity of the soft surface coating at the periphery of the worn or exfoliated portion is increased, it is difficult for the surface coating material to flow from the periphery of the worn or exfoliated portion to the worn or exfoliated portion and accordingly, there is a possibility that the soft surface coating will not be sufficiently repaired.

However, since the first embodiment is arranged to make the mechanical adhesive properties between the soft surface coating 21 and the base metal surface 20*a* of the swash plate main body 20 weak as described above, the soft surface coating 21 flows smoothly, and the portion where the soft surface coating 21 is missing due to wear or exfoliation is promptly repaired.

Figure 3:
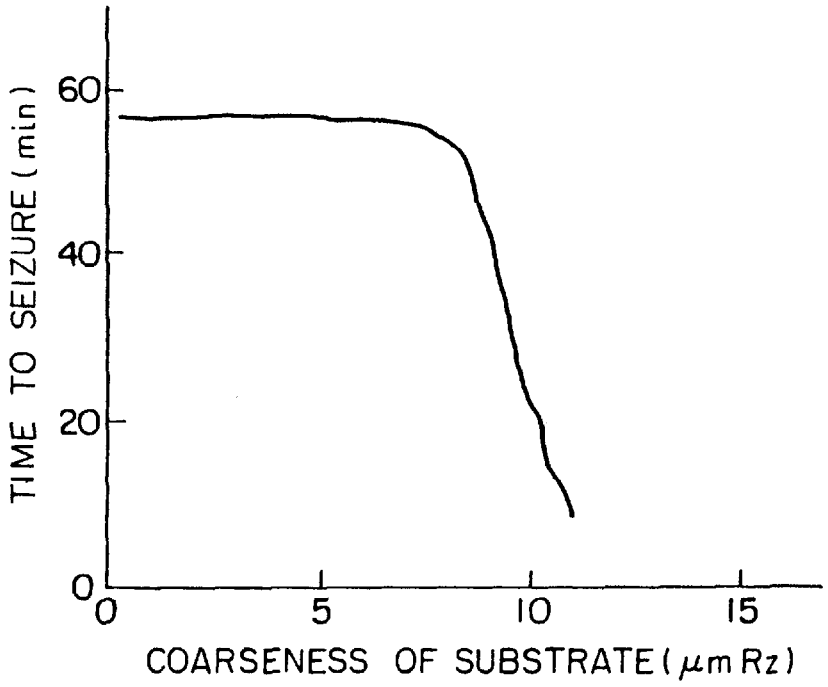
FIG. 3 is a experimental example related to the first embodiment illustrating a relationship between the fluidity of a coating layer containing molybdenum disulfide and the coarseness of the substrate of the coating layer, that is, the relationship between the time until a seizure occurs and the coarseness of the substrate of the coating layer as the sliding surface rotated in a partially exfoliated state.
Figure 4:
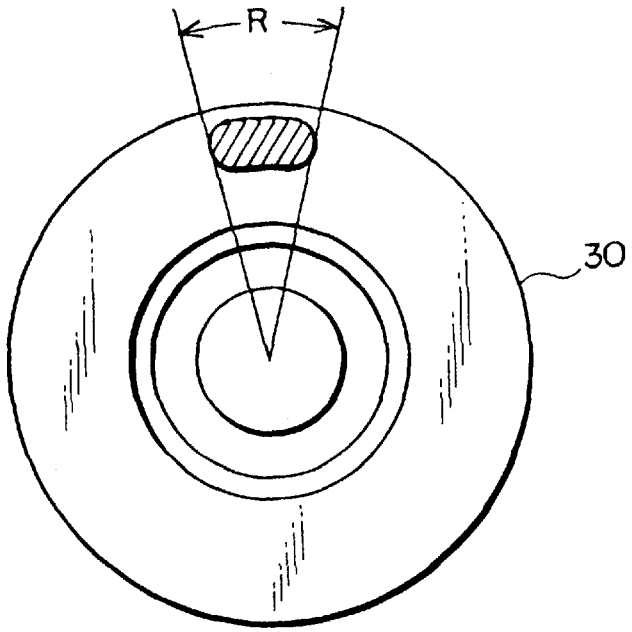
FIG. 4 is a front view of the swash plate showing the position and the size of the exfoliated portion in the experimental example illustrated in FIG. 3.

FIG. 3 is a graph in accordance with an experiment example illustrating the relationship between the fluidity of the soft surface coating and the coarseness of the substrate. The figure shows how the time until seizure occurs changes with respect to the coarseness of the substrate when, assuming that the soft surface coating is exfoliated as the pistons approach their top dead centers, a portion of the soft surface coating on the plate body 30 where the rotation angle R is 20°, as shown in FIG. 4, is exfoliated on the sliding surfaces that come into sliding contact with the shoes, and the plate body 30 is rotated under the state where there is no lubrication. As is apparent from the experimental example, if the average coarseness of the substrate exceeds 8 μmRz at ten point mean roughness, the time until seizure occurs becomes short rapidly. This is supposedly caused by the following. When the coarseness of the substrate is 8 μmRz or less at ten point mean roughness, the fluidity of the soft surface coating of the substrate is good, the soft surface coating is softened by a rise in temperature as the plate body 30 rotates and flows into the exfoliated portion to repair it. On the other hand, when the coarseness of the substrate exceeds 8 μmRz at ten point mean roughness, since the fluidity of the soft surface coating of the substrate is deteriorated, it becomes difficult for the soft surface coating to flow into the exfoliated portion regardless of the rise in temperature as the plate body 30 rotates, which leads to seizure starting from the exfoliated portion. Note that in the present experiment example, the sliding speed on the surface of the plate body 30 at the exfoliated portion was 3 m/s, the shoe load was 1.5 kN (constant), and there were 3 shoes.

Thus, according to the first embodiment, the wear resistance and lubricating ability of the surface of the swash plate 8 which is in sliding contact with the shoes 16 can be maintained at a high level for a longer period of time.

Figure 5:
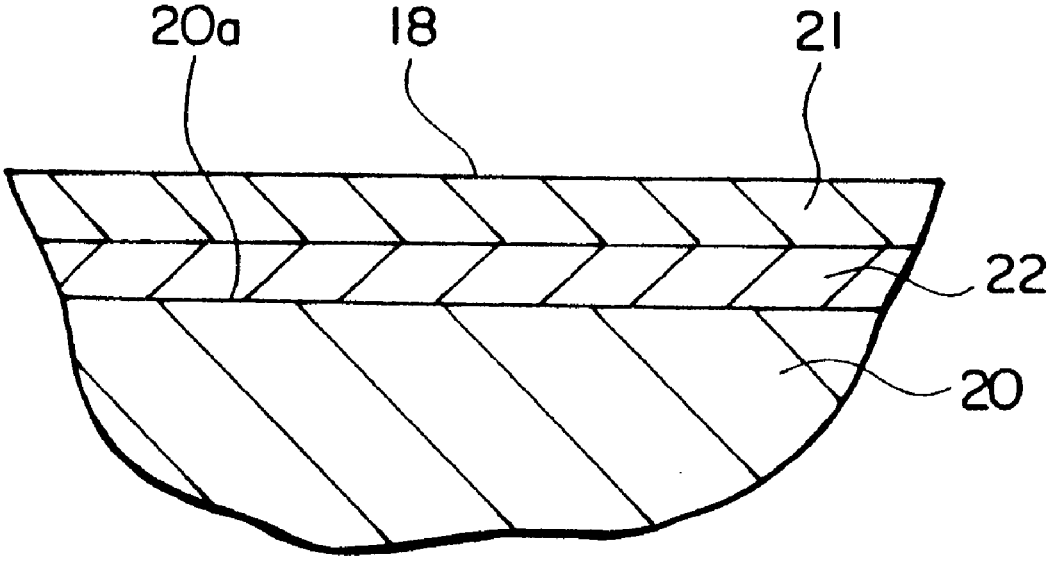
FIG. 5 is a sectional view of the sliding surface portion of a swash plate main body according to the second embodiment.

Next, a second embodiment will be described with reference to FIG. 5.

In the second embodiment, an alloy plating layer 22 mainly composed of tin (Su-Cu alloy as a concrete example) is formed on a base metal surface 20*a* of the sliding surfaces 18 of a swash plate main body 20 and a coating layer containing molybdenum disulfide is further formed thereon as a soft surface coating 21. Note, besides molybdenum disulfide, the coating layer contains polyamide-imide resin or the like as a binder, and also contains graphite or the like as a solid lubricant. Then, the surface of the plating layer 22 as the substrate of the soft surface coating 21 is finished to 3 μmRz or less in coarseness at ten point by mean roughness by finishing the surface of the base metal surface 20*a* of a swash plate main body 20 to 3 μmRz or less in coarseness at ten point mean roughness.

Note that except for the above arrangement, the second embodiment is the same as that of the above first embodiment.

In the second embodiment arranged as described above, the alloy plating layer 22 mainly composed of tin has adhesive properties with the base metal surface 20*a* of the swash plate main body 20 which are better than those of the coating layer containing molybdenum disulfide as the soft surface coating 21 and has excellent wear resistance. Thus, even if the coating layer containing molybdenum disulfide as the soft surface coating 21 is worn or exfoliated by a large sliding load which is caused every time one of the heads of the pistons 11 approaches its top dead center, the alloy plating layer 22 mainly composed of tin can be maintained as the substrate of the soft surface coating 21. Further, since the coating layer containing molybdenum disulfide is compatible with the alloy-plating layer 22 mainly composed of tin and the fluidity of the coating layer is increased, the coating layer is easily repaired and reformed.

Therefore, compared with the first embodiment in which the coating layer containing molybdenum disulfide as the soft surface coating 21 is directly formed on the base metal surface 20*a* of the swash plate main body 20, in the second embodiment, dual surface coatings are formed on the swash plate main body 20. As a result, even if the soft surface coating 21 is worn or exfoliated, since the surface of the alloy plating layer 22 mainly composed of tin is exposed without directly exposing the base metal surface 20*a* of the swash plate main body 20, a higher wear resistance and higher lubricating ability can be further maintained. Since the coating layer containing molybdenum disulfide flows more promptly to the portion where the soft surface coating 21 is worn or exfoliated to thereby repair the portion, the high wear resistance and high lubricating ability can be more reliably maintained. Further, even if the soft surface coating 21 should become very worn or exfoliated and unrepairable, the plating layer 22 mainly composed of tin can be used in its place, so a high lubricating ability can be maintained for a longer period of time.

Although, in the first and second embodiments, the soft surface coating 21 or the dual layers composed of the soft surface coating 21 and the plating layer 22 are formed on the base metal surfaces 20*a* of the swash plate main body 20, they may be formed on the sliding surfaces of the shoes 16. In this case, although a sliding load always acts on the sliding surfaces of the shoes 16, since the heads of the pistons 11 which are engaged with the respective shoes 16 reciprocatively move from their top dead centers to their bottom dead centers as the swash plate 8 rotates, the sliding load constantly changes. Therefore, the soft surface coating 21 is repaired when the sliding load is small.

Although, in the first and second embodiments, the soft surface coating 21 or the dual layers composed of the soft surface coating 21 and the plating layer 22 are formed on the entire base metal surfaces 20*a* of the swash plate main body 20, they may be partially formed on only the portions of the sliding surfaces of the swash plate main body 20 that come into contact when the pistons 11 are at their top dead centers and the peripheries of those portions.

Although, in the first and second embodiments, the present invention is embodied as a swash plate compressor having double-headed pistons, it may also be embodied as a swash plate compressor having single-headed pistons.

INDUSTRIAL APPLICABILITY

As described above, the swash plate compressor is useful for use in vehicle air-conditioners, in which severe conditions such as no lubrication at start up and high sliding load are apt to occur in driving.

What is claimed is:

1. A swash plate compressor comprising a cylinder block having a plurality of cylinder bores, a drive shaft rotatably supported in said cylinder block, a swash plate held on said drive shaft so as to rotate with said drive shaft, pistons slidably disposed in said cylinder bores, and shoes slidably provided between said pistons and said swash plate to reciprocatively move said pistons by the rotation of said swash plate, in which a soft surface coating is formed on sliding surfaces of any one of said swash plate and said shoes which come into contact with each other, wherein the coarseness of the surface of the substrate of said soft surface coating is made to be a coarseness of 8 μmRz or less at ten point mean roughness.

2. A swash plate compressor according to claim 1, wherein said coarseness is made to be a coarseness of 5 μmRz or less at ten point mean roughness.

3. A swash plate compressor according to claim 1, wherein said coarseness is made to be a coarseness of 3 μmRz or less at ten point mean roughness.

4. A swash plate compressor according to any one of claims 1 through 3, wherein said soft surface coating is a coating layer containing molybdenum disulfide.

5. A swash plate compressor according to any one of claims 1 through 3, wherein an alloy plating layer composed of soft metal is formed on sliding surfaces of any one of said swash plate and said shoes which come into contact with each other, and said soft surface coating containing molybdenum disulfide is formed on said alloy plating layer.

6. A swash plate compressor according to claim 5, wherein said alloy plating layer composed of soft metal is mainly composed of tin.

7. A swash plate compressor according to claim 1, wherein said swash plate is composed of aluminum or an aluminum alloy, and said soft surface coating is formed on portions of said sliding surfaces of said swash plate which come into contact with said shoes to include at least the portions thereof subjected to a sliding load from said shoes when said pistons are at their top dead centers.

8. A swash plate compressor comprising a cylinder block having a plurality of cylinder bores, a drive shaft rotatably supported in said cylinder block, a swash plate held on said drive shaft so as to rotate with said drive shaft, pistons slidably disposed in said cylinder bores, and shoes sidably provided between said pistons and said swash plate to reciprocatively move said pistons by the rotation of said swash plate, having an alloy plating layer mainly composed of tin formed on sliding surfaces of any one of said swash plate and said shoes which come into contact with each other, and having a soft surface layer formed on said alloy plating layer, said soft surface layer containing molybdenum disulfide, wherein the coarseness of the surface of the substrate of said alloy plating layer is made to be a coarseness of 8 $\mu$m Rz or less at ten point mean roughness, and wherein the coarseness of the surface of the alloy plating layer is made to be a coarseness of 3 $\mu$m Rz or less at ten point mean roughness.

9. A swash plate compressor according to claim 8, wherein said coarseness of said surface of the substrate of the alloy plating layer is made to be a coarseness of 3 $\mu$m Rz or less at ten point mean roughness.

10. A swash plate compressor according to claim 8, wherein said swash plate is composed of aluminum or an aluminum alloy.

11. A swash plate compressor according to claim 10, wherein said coating layer containing molybdenum disulfide is formed on portions of said alloy plating layer which come into contact with said shoes to include at least the portions thereof subjected to a sliding load from said shoes when said pistons are at their top dead centers.

* * * * *

UNITED STATES PATENT AND TRADEMARK OFFICE

CERTIFICATE OF CORRECTION

PATENT NO. : 6,192,784 B1
DATED : February 27, 2001
INVENTOR(S) : Takayuki Kato et al.

It is certified that error appears in the above-identified patent and that said Letters Patent is hereby corrected as shown below:

Column 1,
Line 18, please change "sidably inserted" to -- slidably inserted --;
Line 46, please change "Specifically, a average coarseness" to -- Specifically, a coarseness --;

Column 5,
Line 11, please change "a average coarseness" to -- a coarseness --;
Line 12, please change "μmRz or less or less, preferably 5μmRz or less or less" to -- μmRz or less at ten point mean roughness, preferably 5μmRz or less at ten point mean roughness, --;

Column 10,
Line 8, please change "of 8μm Rz or less" to -- of 8μmRz or less --;
Line 10, please change "of 3μm Rz or less" to--;of 3μmRz or less --
Lines 14-15, please change "of 3 μm Rz or less to -- of 3μmRz or less --

Signed and Sealed this

Twenty-first Day of May, 2002

*Attest:*

*Attesting Officer*

JAMES E. ROGAN
*Director of the United States Patent and Trademark Office*